US005573465A

United States Patent [19]

Kitchen et al.

[11] Patent Number: 5,573,465

[45] Date of Patent: Nov. 12, 1996

[54] PENDULUM DAMPER

[76] Inventors: William J. Kitchen, 10385 Sailor Ct., Longmont, Colo. 80501; Kenneth G. Bird, 605 E. 12, Casper, Wyo. 82609

[21] Appl. No.: 600,902

[22] Filed: Feb. 13, 1996

Related U.S. Application Data

[63] Continuation of Ser. No. 361,185, Dec. 21, 1994, abandoned.

[51] Int. Cl.[6] ..... A63G 9/00

[52] U.S. Cl. ..... 472/118; 472/119; 472/133

[58] Field of Search ..... 472/118, 119, 472/135, 136, 137, 80, 50, 68

[56] References Cited

U.S. PATENT DOCUMENTS

| | | | |
|---|---|---|---|
| 1,229,519 | 6/1917 | Rach | 472/80 |
| 1,548,535 | 8/1925 | Lydecker | 472/118 X |
| 1,941,024 | 6/1933 | Stanzel . | |
| 2,172,451 | 11/1936 | Powers . | |
| 2,217,548 | 4/1938 | Hemmingsen . | |
| 2,448,325 | 8/1948 | Poorman, Jr. | 472/118 X |
| 3,391,931 | 7/1968 | Worley | 472/118 |
| 3,885,788 | 5/1975 | Harris . | |
| 5,188,566 | 2/1993 | Böhme . | |
| 5,267,906 | 12/1993 | Kitchen et al. . | |
| 5,314,383 | 5/1994 | Fabbri . | |

*Primary Examiner*—Kien T. Nguyen
*Attorney, Agent, or Firm*—Rick Martin

[57] ABSTRACT

A passenger car sized pendulum is supported by a moving pivot point. The moving pivot point is forced horizontally by the angular movement of the pendulum. By resisting the horizontal force the angular movement of the pendulum is reduced. The preferred embodiment for resisting the horizontal force is a parallelogram assembly supporting a horizontal support platform. The parallelogram assembly has a damping cylinder resisting the horizontal force.

22 Claims, 5 Drawing Sheets

PENDULUM DAMPER

CROSS REFERENCE PATENTS

This application is a continuation of application Ser. No. 08/361,185 filed Dec. 21, 1994, now abandoned. U.S. Pat. No. 5,267,906 (1993) to Kitchen et al. is incorporated herein by reference.

FIELD OF INVENTION

The present invention relates to either damping or accelerating a pendulum by means of moving the pendulum pivot either in sync or out of sync with the pendulum.

BACKGROUND OF THE INVENTION

Kitchen's '906 patent and pending U.S. application Ser. No. 08/266,200 filed Jun. 27, 1994 describe large swing type amusement rides. Below follows a brief description of these amusement rides.

The various amusement rides provide a swing type amusement ride for raising one or more riders from a position at or near a support surface aloft to a height of ten meters or more, and then releasing the rider to swing in a curved trajectory for thrill and excitement, but with little or no stress placed on the body of the rider. The amusement ride includes a support structure extending upwardly at least eleven meters above the ground (and as much as several hundred meters or more). The support structure may be a static tower, a static derrick, a static arch, a bridge, other static man-made structures, a crane, naturally occurring geological formations, and the like.

One end of a rider support line is secured to the upper portion of the support structure at a point which is at least eleven meters from the ground, while the second end of the rider support line is secured to a rider securing attachment, to which a rider can be secured during the ride, and then removed, such as harness. In preferred embodiments, one end of a second line, which is used as a stabilization line, is also secured to the upper portion of the support structure, while the second end of the stabilization line is also secured to the harness or other attachment which secures the rider during the ride.

Disposed near the support structure is an upright launch structure having an upper portion which is spaced from the upper portion of the support structure. The launch structure may also be a static tower, a static derrick, a static arch, a bridge, other static man-made structures, a crane, naturally occurring geological formations, man made geological formations, and the like, which have an upper portion which has a height which reaches or exceeds at least eleven meters from the ground (and as much as several hundred meters or more). The upper portion of the launch structure carries a launch line which has a free end which is capable of being lowered and of being raised to a height which reaches or exceeds at least ten meters above the ground. One end of the launch line is designed to be releasably attached to the harness attachment which is releasably secured to the rider. As detailed below, the launch line is capable of raising a rider who is releasably secured to a harness or other attachment to a height of at least ten meters above the ground. The launch line is attached to the release device, preferably a quick release device. The release device, is mounted between the attachment device which carries the rider, and the launch line, preferably in a manner and in a position which allows the rider to release the launch line and begin the swing descent at will.

In operation, in preferred embodiments, the rider is initially in an upright standing position on the ground, or on a stand closely adjacent to the ground, beneath the support structure. The attachment, for example in the form of a body harness, may be secured to the rider by the ride operators at this location or prior to the ride reaching this location. The ride ground crew then attach the support and stabilization lines which are connected to and which depend from the support structure to the body harness attachment of the rider. The ground crew next attaches the launch line which depends from the launch structure to the release device mounted on the body attachment of the rider.

The ride operators then activate the launch line to retract it towards the launch structure at a controlled speed. This causes the rider to be moved laterally from beneath the support structure and towards the launch structure. If the rider is properly connected to the support and/or stabilization lines, then at this time the rider will be raised aloft from the ground, and be suspended from the support structure by the support and/or stabilization lines, and from the launch structure by the launch line. It is to be noted that, as a fail safe measure, if the rider is not properly connected to the support and/or stabilization lines then at this time the rider will be pulled laterally, but will not be immediately raised aloft from the ground, and the operation can be terminated. After the stand on which the rider initially stands is removed, or after the rider is raised aloft by the launch line, he or she is preferably rotated to a prone, face down position by the harness attachment, as detailed below. As the launch line continues to be retracted towards the launch structure at a controlled speed, the rider is raised in a curved path further and further from the ground, towards the launch structure and away from the support structure.

When the rider reaches a predetermined height, preferably ten meters or more above the ground, or when the rider activates the release, the launch line is disconnected from the rider, and the rider begins to fall in a curved trajectory which simulates the sensation of being in "body flight". The resulting sensation, including acceleration to speeds from about seventy to more than eighty kilometers per hour, is similar to hang-gliding and skydiving, including the surge of the wind and the excitement of "ground rush" 2 while approaching and passing close over the ground and objects projecting from the ground at high speeds. The rider then continues to swing back and forth in a curved trajectory underneath the support structure until he or she slows to a speed at which the ride operators may stop and remove him or her from the harness attachment.

As used herein, the "ground" may be an actual ground surface, or a man made surface such as pavement, tarmac, a concrete pad and the like. The height of the structures or of the rider from the ground may be measured with respect to the actual "ground", or to a depression below the structures, such as a river bed, ravine, valley, or the like. As used herein, the portion of the support structure to which the support line is attached, and the portion of the launch structure from which the launch line is attached will always be considered to be the "upper portion" of the structure.

In an alternative mode of operation, the rider may be lifted directly to the top of the launch structure, the harness or other attachment secured to the rider, and the support line and stabilization line secured to the harness or other attachment. Then, the rider may launch him or herself from the launch structure and experience a ride which is similar to that of the preferred embodiment. In such an operation, the support line and stabilization line will be raised to the top of the launch structure by the launch line. This alternative mode of operation will allow the support and stabilization line to have a substantial amount of slack, thus making the initial part of the ride to be vertical, rather than curved, or, by proper calculation of height an elasticity, the use of bungee support and stabilization lines.

In another alternative mode of operation, several riders are fastened to the end of the support line. Each rider wears a harness. Each harness is connected to the end of the support line. The riders can share the excitement and thrill of flying.

In another alternative mode of operation, several riders are fastened to a solid saucer structure. Four parallel support lines approximately 100 meters long secure the saucer to a support structure. The saucer is lifted with a launch line approximately 100 meters to a launch structure then released, in much the same way as the single rider embodiment. In preferred embodiments, a second set of four parallel lines are used for stabilization.

The solid saucer embodiment has been nicknamed the Sky Saucer. Some Sky Saucer plans call for saucers holding over sixty passengers. Stopping a saucer of this weight by only using rubber tires and brake working on the limited braking runway of the loading platform for the passengers would take many pendulum oscillations. Additionally, tires and brakes would wear out frequently. Finally smells from braking mechanisms and tires would be offensive.

The main problem addressed by the present invention is how to damp the pendulum motion of the huge Sky Saucer from the pendulum's pivot point. No known prior art ever addressed a problem of this nature. Below follows a brief summary of the closest known related art.

U.S. Pat. No. 1,941,024 (1933) to V. Stanzel discloses an amusement ride having an airplane mounted on a rotating balance arm. The balance arm has a weight 13 which can be moved to accommodate various passenger weight loads.

U.S. Pat. No. 2,172,451 (1939) to Lowers discloses a vertical tower having a top passenger compartment. The vertical pivots in a pendulum fashion into a left and right horizontal position. A counterbalance weight is adjusted to compensate for varying passenger weights.

U.S. Pat. No. 2,217,548 (1940) to Hemmingsen discloses an amusement car and circular concave track ride. The car moves around the track as it rotates around a support pole. The car travels up the side of the track at speed.

U.S. Pat. No. 3,885,788 (1975) to Harris discloses an amusement ride which is basically a giant see-saw. An adjustable counterbalance allows a rider to vault to a height of twenty of more feet in a weightless state at the end of a pendulum.

U.S. Pat. No. 5,188,566 (1993) to Böhme discloses a looping swing suspended in a pendulum fashion.

U.S. Pat. No. 5,314,383 (1994) to Fabbu discloses a collapsible rocking ship type swing ride. A counterbalance folds inward by a gear connection to the seat.

U.S. Pat. No. 5,267,906 (1993) to Kitchen et al. discloses the Sky Fun body flight ride.

SUMMARY OF THE INVENTION

The main object of the present invention is to provide an externally powered pendulum damping means using a synchronized pendulum pivot mechanism especially suited for stopping large amusement park swing type rides.

Another object of the present invention is to maintain a level platform for the multiple support lines of the ride at the pendulum pivot, even during the damping process.

Still another object of the present invention is to provide a pendulum acceleration means by using the externally powered pendulum damping means in an unsynchronized oscillation.

Other objects of this invention will appear from the following description and appended claims, reference being had to the accompanying drawings forming a part of this specification wherein like reference characters designate corresponding parts in the several views.

The preferred embodiment supports the Sky Saucer cables from a horizontal platform. The horizontal platform is supported from the uppermost I beam(s) of the ride support tower by at least one pair of pivoting parallelogram support arms. Preferably two pair of pivoting parallelogram support arms are used to support the horizontal platform.

In order to stop the Sky Saucer at least one hydraulic cylinder is used to move the horizontal platform in the same direction as the swing of the Sky Saucer. This causes the inertial movement of the Sky Saucer to be reduced in proportion to the distance the horizontal platform is moved away from the central pendulum pivot point. Since the horizontal platform is supported in a parallelogram configuration, then the horizontal platform rises a slight distance as it is pushed to either side. This rising action helps to maintain a smooth ride. Furthermore, the parallelogram configuration is self-centering which facilitates centering the Sky Saucer on the passenger loading platform.

DESCRIPTION OF THE PREFERRED EMBODIMENT

Figure 1:
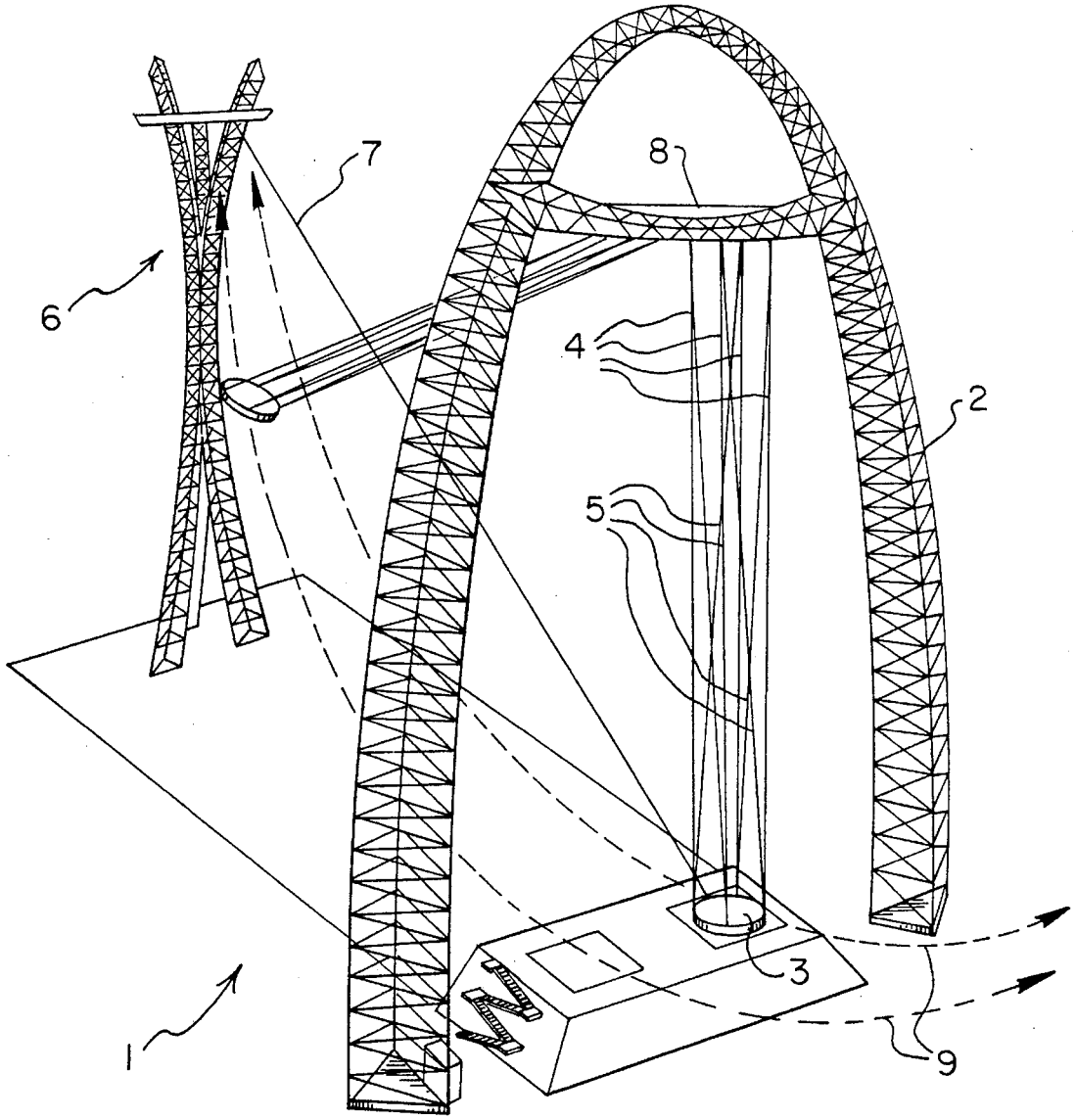
FIG. 1 (PRIOR ART)
FIG. 1 (prior art) is a side perspective view of the Sky Saucer ride.

Referring first to FIG. 1 a side perspective view of the prior art Sky Saucer 1 is shown. The prior art Sky Saucer 1 consists of a solid saucer structure 3 attached to a support structure 2 by four parallel support lines 4 which are approximately 100 meters long. The Sky Saucer ride 1 acts like a giant pendulum, and can hold over sixty passengers in the solid saucer structure 3. The solid saucer structure 3 is stabilized using an additional set of four parallel lines 5. Both the support lines 4 and the stabilization lines 5 are attached to the support structure 2 via the support frame 8.

The amusement ride 1 is started by lifting the solid saucer structure 3 approximately 100 meters to a launch structure 6 using a launch line 7. Once the solid saucer structure 3 is lifted approximately 100 meters, it is released and allowed to oscillate in a pendulum swing arc 9 until the predetermined ride time is complete. When the ride is over, the Sky Saucer 1 is stopped and the passengers unloaded from the saucer 3. The following description will use the same numbers for prior art elements because in the following description only the damping mechanism elements differ. The prior art ride elements are identical to one another throughout the application.

Figure 3:
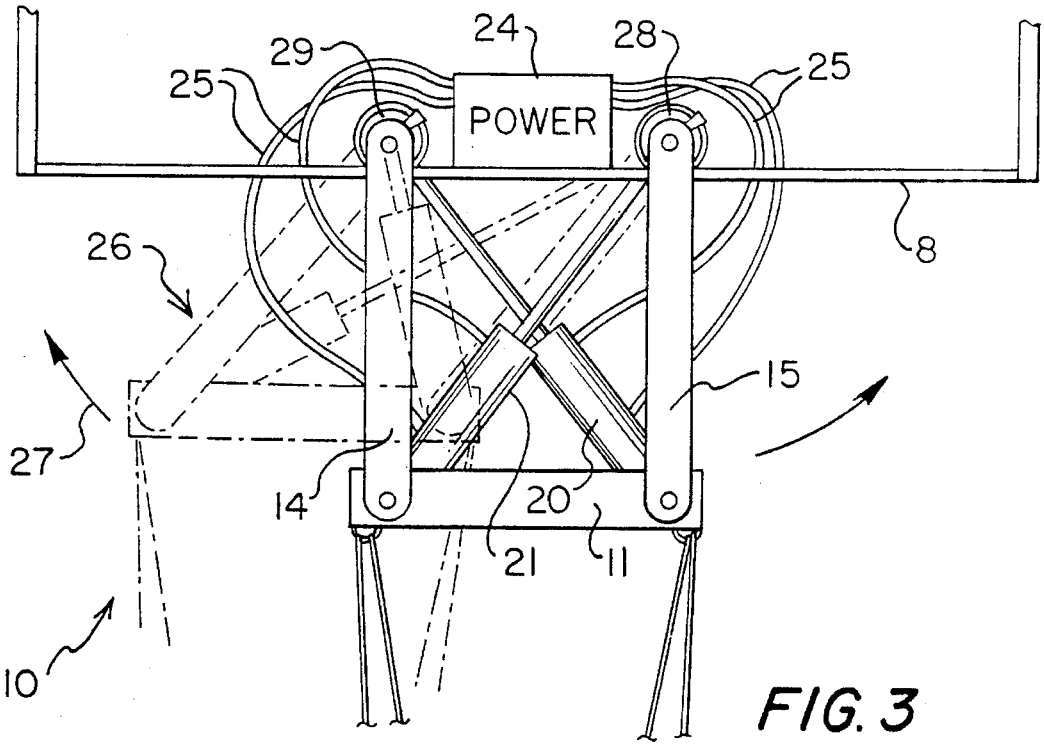
FIG. 3 is a side plan view of the preferred embodiment of the mechanism of FIG. 2.
Figure 4:
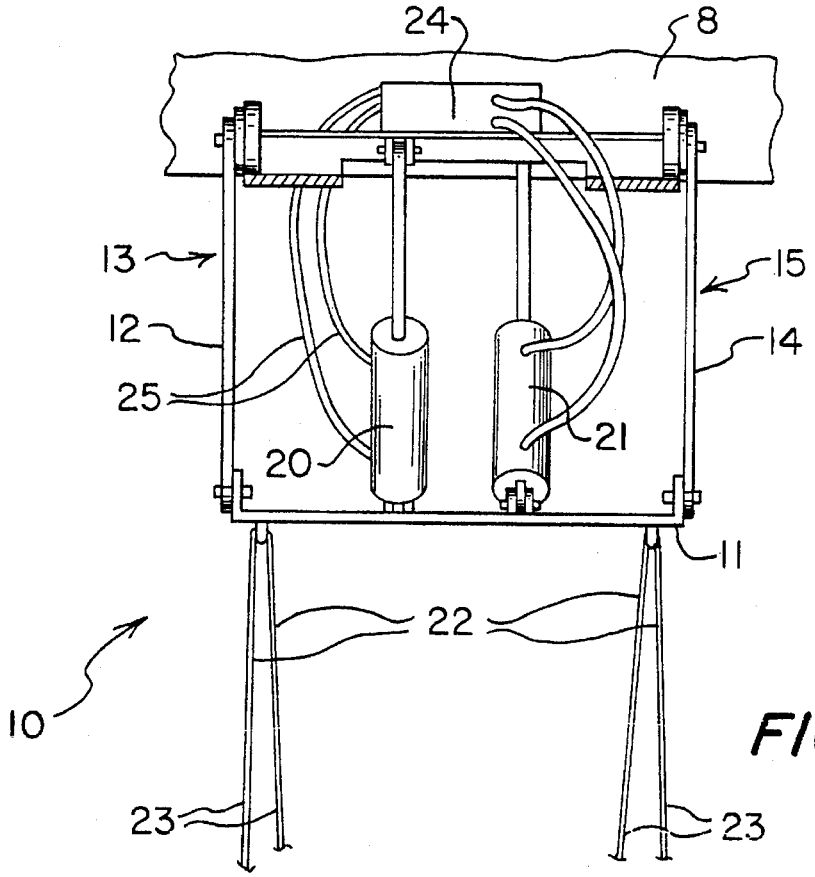
FIG. 4 is a front plan view of the mechanism of FIG. 2 mounted on the prior art Sky Saucer ride of FIG. 1.

Referring next to FIGS. 3, 4 a front plan view of the preferred embodiment of the damping mechanism 10 which is used to stop the amusement ride 1 oscillation is shown. The damping mechanism 10 is fixed in the longitudinal and lateral center of the support frame 8 of the prior art support structure 2 of FIG. 1.

The damping mechanism 10 consists of a horizontal platform 11 which is attached to the support frame 8 by two pairs of parallel arms 12, 13, 14, 15. Each parallel arm 12, 13, 14, 15, is pivotally attached to both the support frame 8, and to each corner of the horizontal platform 11.

A powered piston 21 is fixed diagonally from the support frame 8 to the horizontal platform 11. Correspondingly, behind piston 21 a second powered piston 20 is fixed diagonally from the support frame 8 to the horizontal platform 11. The pistons 20, 21 are connected to a power source 24 by hydraulic lines 25.

The powered pistons 20, 21 act to move the horizontal platform 11 in a front to back arc as denoted by arrow 27.

Referring to FIGS. 3, 4 support lines 22 and stabilization lines 23 are fixed to each corner of the horizontal platform 11 at their top end. The support lines 22 and stabilization lines 23 are fixed to the solid saucer 3 at their bottom end as shown in FIG. 1.

Figure 2:
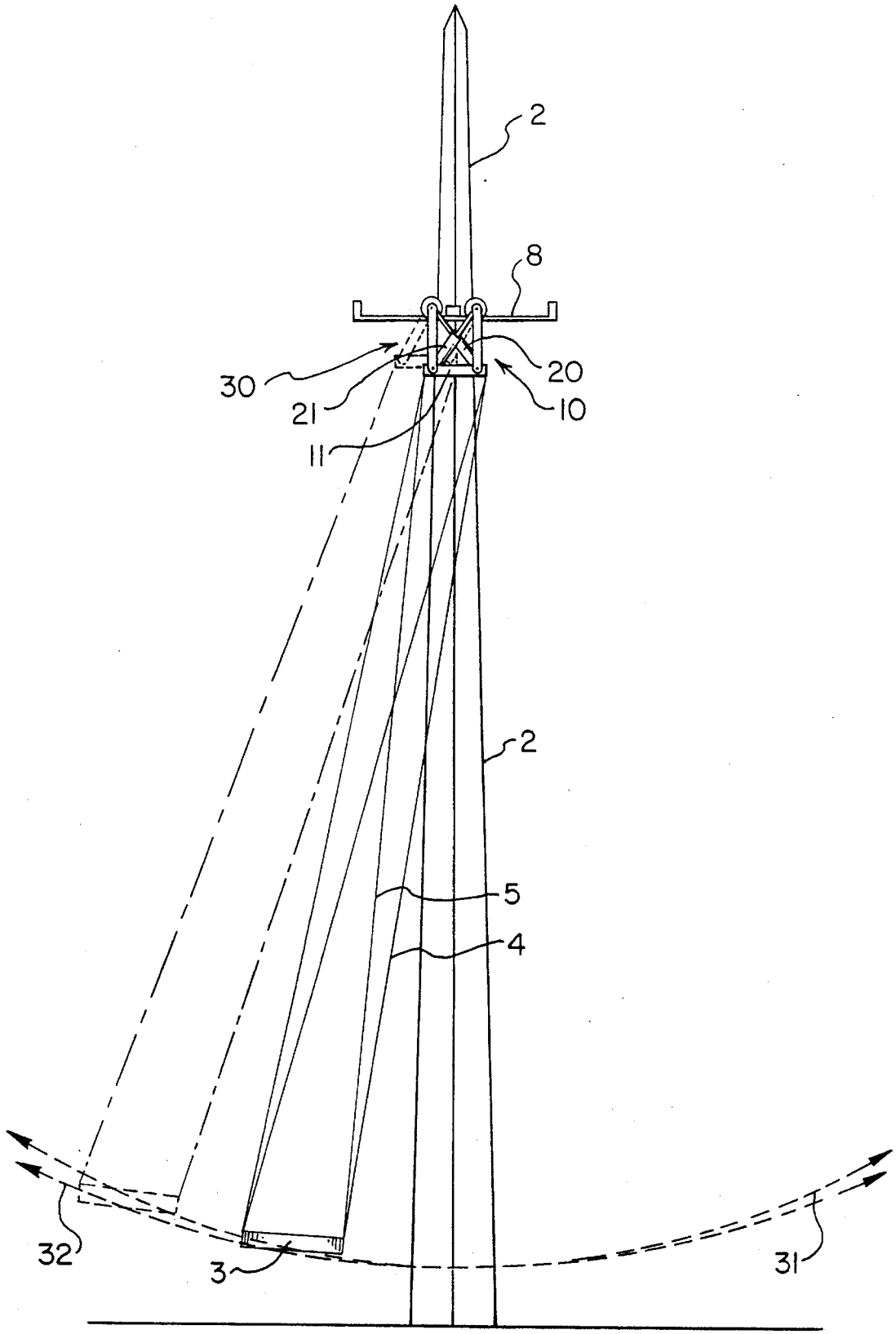
FIG. 2 is a side plan view of the preferred embodiment of the damping mechanism mounted on the prior art Sky Saucer ride of FIG. 1.

Referring next to FIG. 2 a side plan view of the preferred embodiment of the damping mechanism 10 mounted on the Sky Saucer of FIG. 1 is shown. The amusement ride 1 can still be started as it was in the prior art by releasing the passenger filled solid saucer 3 after it has been elevated approximately 100 meters. The solid saucer 3 in concert with the support and stabilization lines 4, 5 acts as giant pendulum in a harmonic system. The saucer 3 will then swing in a pendulum arc denoted by arrow 31.

Alternatively the amusement ride 100 can now be started by activating the powered pistons 20, 21. The hydraulic pistons 20, 21 will first displace the horizontal platform 11 in one direction. The pistons 20, 21 will then act in concert to displace the horizontal platform in the opposite direction. The pistons will continue this front to back motion until the desired preset arc amplitude is achieved and the solid saucer 3 is elevated approximately 100 meters. Once the saucer has reached its desired elevation the pistons 20, 21 will be turned off. The solid saucer 3 of the amusement ride 100 will be allowed to oscillate along the pendulum arc 31 for most of the ride.

Once the amusement ride 1 has been started, it will naturally come to a stop unless outside energy is fed into the system. The amusement ride 1 will come to halt due to the energy it loses to friction in the system. For an amusement ride, however, the stopping time must be quicker than the natural stopping time and within the ride operator's control.

The amusement ride 1 may be stopped by reactivating the pistons 20, 21. Once the saucer 3 has been elevated approximately 100 meters, either by launch line or powered pistons, it will travel along a pendulum arc denoted by arrow 31. By activating the pistons 20, 21, the horizontal platform 11 will be moved to position 30 denoted by the dashed lines. Moving the horizontal platform 11 to position 30 drops the solid saucer 3 a small distance. As a result the solid saucer 3 travels a long a lower pendulum arc denoted by arrow 32. The lower pendulum arc 32 is out of sync with it's original pendulum arc 31. This greatly increases the energy lost out of the harmonic system, and the amusement ride 1 comes quickly to a halt.

The amusement ride 1 may be stopped by using brakes 28, 29 shown in FIG. 3. The brakes 28, 29 increase the energy lost from the harmonic system through friction. The amusement ride 1 may also be stopped more quickly by using a combination of piston 20, 21 activation and brake 28, 29 activation.

Figure 6:
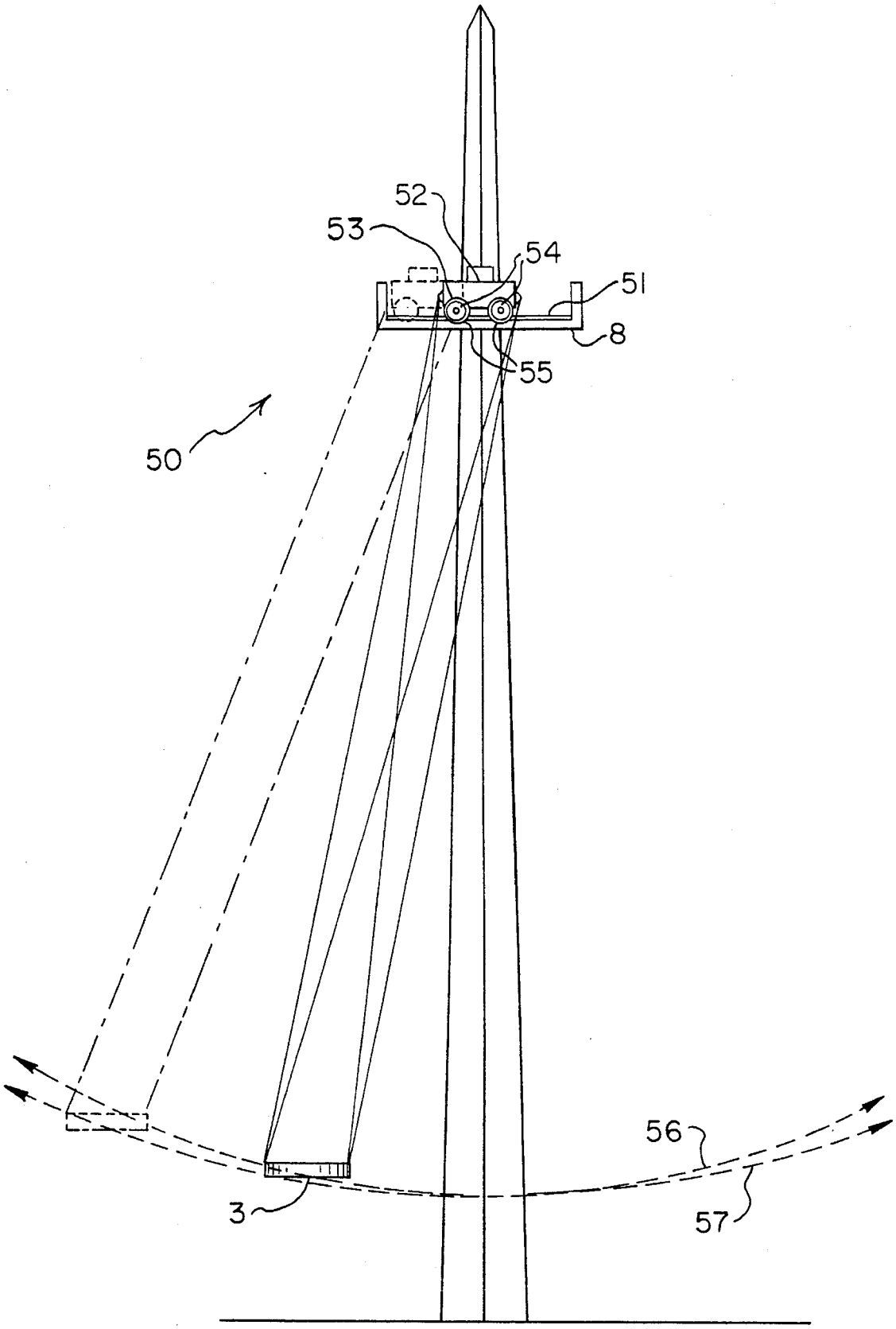
FIG. 6 is a side plan view of yet another alternate embodiment having a trolley car type engine to accelerate or decelerate the Sky Saucer.

Referring next to FIG. 6 a side plan view of an alternative trolley embodiment of the damping mechanism 50 is shown. The alternative trolley damping mechanism 50 consists of placing rail 51 on the support frame 8 of the amusement ride 1. A trolley 52 with a motor 53 is placed on the rail 51 of the support frame 8. The trolley wheels 54 are fitted with brakes 55.

The amusement ride 1 can be started as it was in the prior art Sky Saucer ride shown in FIG. 1 by elevating the solid saucer 1 with a launch line (not shown). The trolley 52 must be braked to remain stationary during the ride initiation. The solid saucer 3 will then oscillate in a pendulum arc denoted by arrow 56.

The amusement ride 1 can also be started by activating the trolley 52 so that it travels back and forth along the rail 51 of the support frame 8. Once the solid saucer 3 has reached an elevation of approximately 100 meters, the trolley 52 will be stopped. The front to back motion of trolley 52 will result in the solid saucer 3 traveling in a pendulum arc denoted by arrow 56.

To stop the amusement ride 1, the brakes 55 can be released, and the trolley 52 will be pulled in the direction that the solid saucer 3 is traveling. Displacement of the trolley 52 causes the solid saucer 3 to lose elevation, and the solid saucer 3 will travel along a lower pendulum arc denoted by arrow 57. The lower pendulum arc 57 is out of sync with the original pendulum arc 56. As a result energy loss from the harmonic system is increased, and the amusement ride 1 is more quickly brought to a halt.

Another mode of damping the pendulum is to accelerate the trolley 52 in the direction of the pendulum swing. The pendulum oscillation will be damped with the same theory of operation as described in FIG. 2. Also, the trolley brakes 55 can be used to increase frictional energy loss and more quickly stop amusement ride 1.

Figure 5:
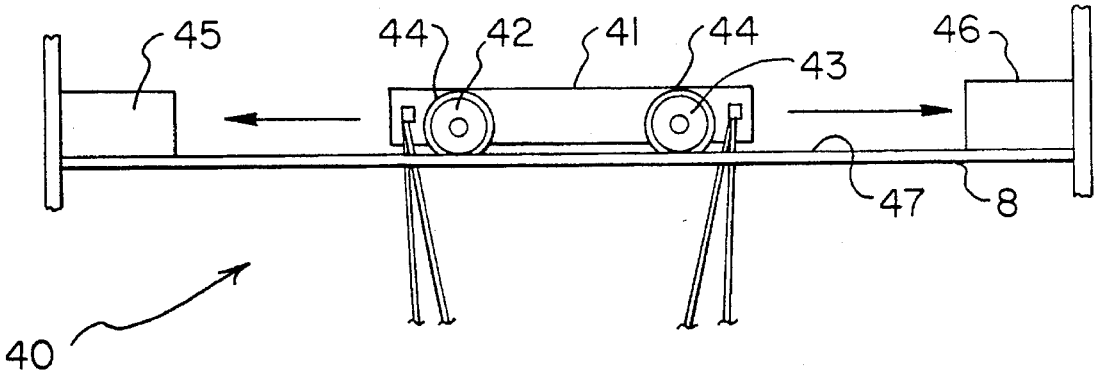
FIG. 5 is a side plan view of an alternate embodiment.

Referring next to FIG. 5 another alternative embodiment damping mechanism 40 is shown. Damping mechanism 40 comprises a rail car 41 with wheels 44, 43 that roll along a track 47 which is mounted on support frame 8. At each end of the track 47 there are displacement blocks 45, 46. Blocks 45, 46 may be constructed of rubber or any other elastic compressible material. The amusement ride is initiated as described in FIG. 1.

The rail car 41 will be pulled in the direction in which the solid saucer (not shown) is traveling. This will cause the resulting pendulum arc to become out of sync with the original pendulum arc and more quickly stop the saucer (not shown) as described in FIG. 2. The rail car 41 will also collide with the displacement blocks 45, 46 stopping the saucer oscillation more rapidly than without the displacement blocks. Brakes (not shown) could also be added to the embodiment.

Figure 7:
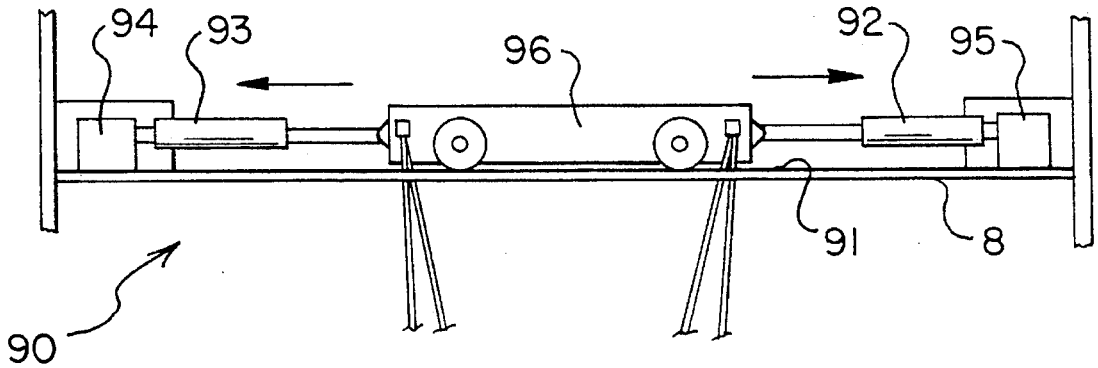
FIG. 7 is a side plan view of yet another alternate embodiment using damping pistons. Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Referring next to FIG. 7 a side plan view of yet another alternate embodiment 90 using externally powered damping pistons 92, 93 is shown. Once again a rail car 96 is placed on rails 91 which are mounted on the support frame 8 of amusement ride 1. An externally powered damping piston 92, 93 is attached to each end of rail car 96. Thus, externally powered damping piston 92 is attached to rail car 96 at one end and power source 95 on its opposing end. Externally powered damping piston 93 is also attached to rail car 96 at one end and power source 94 on its opposing end.

The amusement ride 1 can be initiated as described in FIG. 1 or the pistons 92, 93 can be activated to move the rail car 96 in a front to back motion. Once the amusement ride 1 is initiated, the externally powered damping pistons 92, 93 are deactivated. The rail car 96 will be pulled along the track 91 in the direction that the solid saucer (not shown) travels. The motion of the rail car 96 will result in the lowering of the solid saucer. The swing arc of the solid saucer will then become out of sync, draining energy out of the system as described in FIG. 6. Additionally, the inactivated externally powered damping pistons 92, 93 will act to further damp the oscillation of the amusement ride 1.

Although the present invention has been described with reference to preferred embodiments, numerous modifications and variations can be made and still will the result will come within the scope of the invention. No limitation with respect to the specific embodiments disclosed herein is intended or should be inferred.

I claim:

1. A pendulum damping apparatus comprising:

a pendulum having a support line affixed to a moving pivot means;

said moving pivot means having a horizontal vector of motion; and an externally powered damping means corrected to said pivot means and functioning to counter the horizontal vector of motion, thereby reducing the angular movement of the pendulum.

2. The apparatus of claim 1, wherein said moving pivot means further comprises a vehicle having wheels.

3. The apparatus of claim 2, wherein said horizontal vector of motion is caused by an angular movement of the pendulum.

4. The apparatus of claim 3, wherein said externally powered damping means further comprises a damping piston.

5. The apparatus of claim 3, wherein said moving pivot means further comprises a wheel and said damping means further comprises a brake for the wheel.

6. The apparatus of claim 3, wherein:

said pendulum further comprises a pendulum support frame;

said moving pivot means being supported by said pendulum support frame, further comprises a vehicle; and said externally powered damping means further comprises a power means functioning to accelerate the vehicle in the direction of the angular movement of the pendulum, thereby reducing the angular movement of the pendulum.

7. The apparatus of claim 3, wherein said pendulum further comprises:

a pendulum support frame; and said moving pivot means further comprises a pair of parallel pivoting support arms depending from the pendulum support frame and pivotally affixed at each of the first and second ends of the pendulum support frame, thereby forming a parallelogram assembly among the pendulum support frame, the pair of pivoting parallel support arms, and the horizontal support platform.

8. The apparatus of claim 7, wherein said externally powered damping means further comprises a damping piston fixed to said moving pivot means.

9. The apparatus of claim 1, wherein said externally powered damping means further comprises a powered piston and said horizontal vector of motion is initiated by said powered piston.

10. The apparatus of claim 1, wherein:

said moving pivot means further comprises a motorized vehicle; and said horizontal vector of motion is caused by activation of said motorized vehicle.

11. The apparatus of claim 10, wherein said externally powered damping means further comprises a brake for said motorized vehicle.

12. A pendulum damping apparatus comprising:

a pendulum having a mass and a swing arc;

a pendulum support line attached to the pendulum defining a radius of the swing arc;

a horizontal platform functioning to support the pendulum support line;

a pendulum support frame having a first and second horizontal end;

a pair of parallel pivoting support arms depending from the pendulum support frame and pivotally affixed at each of the first and second horizontal ends of the pendulum support frame, thereby forming a parallelogram assembly among the pendulum support frame, the pair of pivoting parallel support arms, and the horizontal support platform; and a powered piston affixed to one horizontal end of the horizontal support platform, functioning to move the horizontal support platform, thereby lowering the pendulum mass out of sync with the pendulum swing arc, thus, damping the pendulum swing arc.

13. The apparatus of claim 12, wherein the pendulum mass further comprises an amusement ride passenger compartment, and the pendulum support frame further comprises an amusement ride tower.

14. The apparatus of claim 12, wherein the pair of parallel pivoting support arms further comprise a braking means at a pivot point.

15. The apparatus of claim 12, wherein the powered piston further comprises a power means to move the horizontal support platform, thereby moving the pendulum mass in sync with the pendulum swing arc, thus, increasing an amplitude of the pendulum swing arc.

16. A pendulum damping apparatus comprising:

a pendulum having an angular movement;

a pendulum support line;

a horizontal pendulum support frame having a first and second horizontal end;

a damping vehicle having a wheel riding on the horizontal pendulum support frame and having a support means for the pendulum support line; and said damping vehicle further comprising an externally powered damping means functioning to reduce the angular movement of the pendulum.

17. The apparatus of claim 16, wherein the externally powered damping means further comprises a brake for the wheel.

18. The apparatus of claim 16, wherein the externally powered damping means further comprises an end stop at the first and second horizontal end.

19. The apparatus of claim 18, wherein each end stop further comprises a damping piston connected to the damping vehicle.

20. The apparatus of claim 19, wherein the damping vehicle further comprises a power means to accelerate the damping vehicle.

21. The apparatus of claim 20, wherein the externally powered damping means further comprises a brake for a wheel.

22. The apparatus of claim 21, wherein:

the damping vehicle further comprises a rail car having wheels adapted to rails; and the horizontal pendulum support frame further comprises rails.

* * * * *